United States Patent [19]

Byrne

[11] 4,187,927

[45] Feb. 12, 1980

[54] REMOTELY ACTUATED AUXILIARY PRESSURIZATION SYSTEM

[75] Inventor: James E. Byrne, Oklahoma City, Okla.

[73] Assignee: UEC Manufacturing Company, Oklahoma City, Okla.

[21] Appl. No.: 824,231

[22] Filed: Aug. 12, 1977

[51] Int. Cl.[2] ..... B66F 11/04

[52] U.S. Cl. ..... 182/2

[58] Field of Search ..... 182/2, 148, 63, 18, 182/19; 60/403, 402; 343/225

[56] References Cited

U.S. PATENT DOCUMENTS

| | | | |
|---|---|---|---|
| 2,787,278 | 4/1957 | Mitchell | 182/2 |
| 3,136,385 | 6/1964 | Eitel | 182/2 |
| 3,809,182 | 5/1974 | Wilson | 182/2 |
| 3,844,378 | 10/1974 | Balogh | 182/2 |
| 3,921,748 | 11/1975 | Dunn | 60/403 |
| 3,940,931 | 3/1976 | Renfro | 60/403 |
| 3,952,510 | 4/1976 | Peterson | 60/403 |

*Primary Examiner*—Reinaldo P. Machado

[57] ABSTRACT

The present invention is a remotely actuated battery powered, auxiliary pressurizing system for hydraulically actuated lift arm devices which system is driven independently of the principal power source of the vehicle on which the hydraulic lift arm device may be mounted but utilizes the same hydraulic control system as when the system is being pressurized by the vehicle engine. The invention includes radio or light means to activate the battery powered unit from the working basket or platform without the use of electrical conduits or pneumatic or hydraulic actuation lines within the lift arms and without in any way interfering with the conventional lift arms control system established in the working basket or platform. The remotely actuated battery powered pressurizing system is mounted on the chasis of the vehicle and comprises a battery operated motor pump assembly, control means for the motor pump assembly which latter includes a receiver for the signals transmitted thereto by the actuator on the work platform by radio waves or light rays. Provision is also made for actuating the system without reliance upon the transmission from the work platform, for operating accessories and in event of emergency.

12 Claims, 5 Drawing Figures

REMOTELY ACTUATED AUXILIARY PRESSURIZATION SYSTEM

FIELD OF INVENTION

The present invention relates to the use of truck or trailer mounted equipment in which there is provided a flexible, in the vertical plane, pair of articulated arms, one of which is pivotally mounted in a base which in turn is mounted on the vehicle chassis and a vehicle powered hydraulic system by which the arms can be rotated in a horizontal plane separately or simultaneously with the movement of the articulated arms in the vertical plane. More particularly, the invention relates to a remotely actuated battery powered auxiliary pressurizing system capable of pressurizing the hydraulic system to operate the articulated arms.

BACKGROUND OF THE INVENTION AND PRIOR ART

Widespread employment is made by the construction and utilities industry, particularly the latter, of vehicles having mounted thereon extensible and articulated arms for the purpose of placing men and equipment above ground level for performing some work related to the particular industry. The utilization of the articulated extensible arms permits the employment of a vehicle with a low profile for travelling from job to job and yet provides the necessary means for raising the men and the work pieces to where they are needed.

Since the vehicles frequently are operating in areas remote from an adequate electrical power source, the extension and articulation of the equipment is normally carried out by the use of hydraulic pressure systems. The hydraulic system normally comprises at least one hydraulically extensible cylinder in each arm as well as a hydraulic cylinder at the pivot points of the articulated arms in order to provide the necessary articulation. Since the movement of the arms is accomplished by the extension of the piston rod from the hydraulic cylinder, there is no requirement for considerable flexing of connections between the cylinders and the pressure source and hence the hydraulic system is particularly well adapted for such usage. Battery powered systems are known but they are normally actuated with electrical conductors, fiber optics, or hydraulic or pneumatic lines extending between the battery powered system and the work platform, which presents a potential hazard when the work must be accomplished in the vicinity of high voltage transmission lines. Also the flexing of the articulated arm assemblies has imposed problems on the bending of the electrical conduits, fiber optics, or hydraulic or pneumatic lines, resulting in some instances in the use of a reel-like arrangement for the conduits to solve the problem of extension and retraction of the conduits.

The pressure for a hydraulically operated system is provided by a pump which is operated on a power take-off from the vehicle engine. This can be either an arrangement in the engine compartment or in some instances can be a separate transmission shaft which is engaged by controls within the cab of the vehicle and other means of providing the necessary pumping pressure by use of the vehicle's main engine are available. The power take-off pump builds up pressure in the system and in the movement of the articulated arms is accomplished by actuation of control levers which usually are positioned at the end of one of the arms on which there is attached a working platform or basket. These arrangements are standard and are well known in this art. The pump may also be operated by a separate engine in the case of a trailer mounted lift unit.

The disadvantages of the conventional hydraulic system operated by power take-off are to be found in the fact that such is a gas consuming operation since the vehicle engine must continue to operate. An expensive cooling system for the vehicle engine is required to prevent overheating during the long periods of use. The operation of the vehicle engine not only is a pollutant from a noise standpoint but also emits combustion fumes into the air which are particularly noxious since in many instances the vehicle engine is not able to operate at its most economical speed both as far as gasoline supply is concerned as well as a combustion. The conventional system also has a disadvantage in that if the vehicle engine exhausts its fuel or for some reason becomes inoperative, it is not possible to utilize the equipment on the vehicle from the work platform either for the purpose of performing work or for safety purposes in lowering the equipment and men.

U.S. Pat. No. 3,666,046 discloses a portable scaffold which can be placed on the bed of a pick-up truck. The scaffold comprises a mast which can be raised from a horizontal to a vertical position by a first hydraulic means, and the mast then can be raised or lowered vertically by a second hydraulic means. A platform is attached to the mast for workmen. The platform is moved vertically by means of a separate electrically driven pump which is controlled by an electrical conduit extending from the platform down to the pump motor combination.

SUMMARY OF THE INVENTION

The present invention is an auxiliary battery powered, pressurizing system for hydraulically actuated lift arm devices which is activated and deactivated from a remote position without the use of conductors between the position and the pressurizing unit of the system. The novel system operates independently of the main power source for the vehicle on which the hydraulic lift arm device may be mounted but utilizes the same hydraulic control system as when the system is being pressurized by the vehicle engine. The invention includes radio or light means to activate the battery powered unit from the working platform without the use of conduits or without in any way interfering with the conventional control system established in the working basket or platform. The pressurizing unit of the novel system is mounted on the chassis of the vehicle and comprises a battery operated motor pump assembly, control means for the motor pump assembly which latter includes a receiver for the signals transmitted thereto from the actuator on the work platform by radio waves or light rays. Provision is also made for actuating the system without reliance upon the transmission from the work basket for operating vehicle accessories or in event of an emergency.

BRIEF DESCRIPTION OF DRAWINGS

Illustrative embodiments of the invention are shown in the following drawings which are in no manner to be considered as restrictive of the scope of the invention nor the uses to which it can be employed.

DETAILED DESCRIPTION OF THE INVENTION

Figure 1:
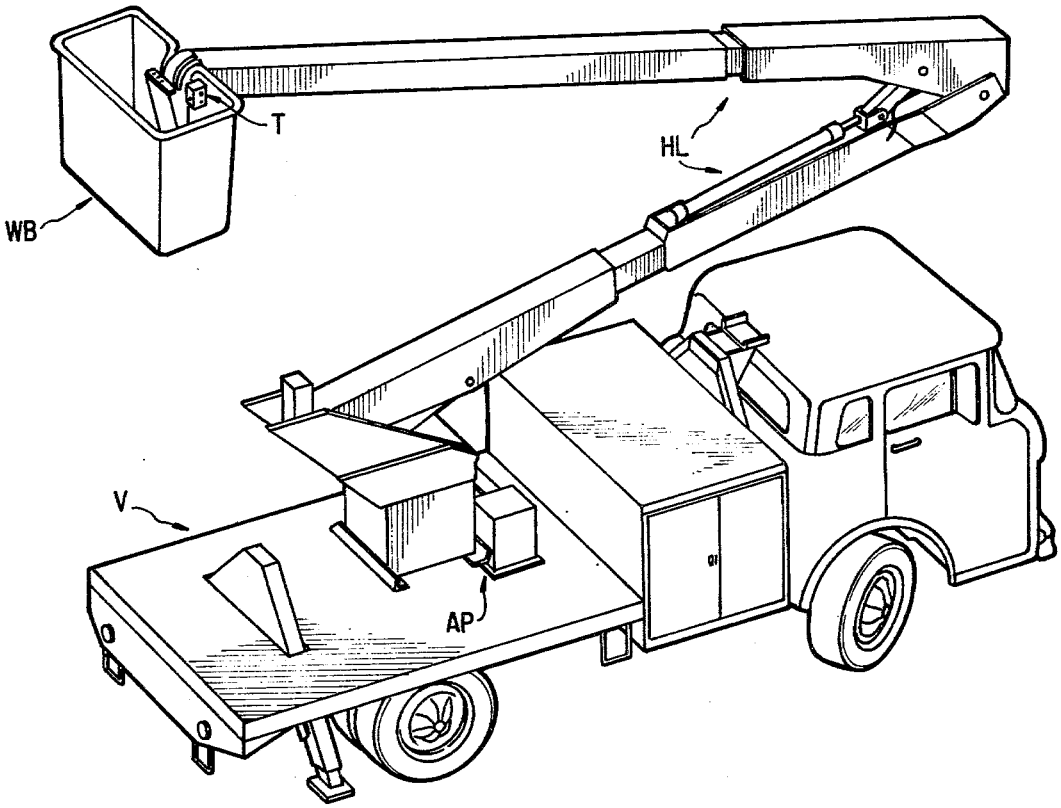
FIG. 1 is a perspective view of a vehicle having a conventional hydraulic lift arm mounted thereon showing one positioning of the components of the present invention.

FIG. 1 shows a conventional type truck V on which there is mounted a well known type of articulated, extensible hydraulic lift arm assembly HL. On the outer end of the upper arm is the familiar work basket WB. The battery powered pressurizing unit of the present invention AP is shown positioned adjacent the pedestal upon which the hydraulic lift arms are mounted. The transmitting means for actuating the battery powered pressurizing unit from the work basket may be positioned anywhere convenient within the work basket and is shown here positioned adjacent the control panel for the hydraulic system of the conventional type which actuates the hydraulic lift arms, being marked as T. It will be understood by those of skill in the art that the remotely actuated battery powered pressurizing unit may be positioned on other parts of the truck body but generally it will be found positioned adjacent the hydraulic input and outlet lines which activate the hydraulic lift arms.

Figure 2:
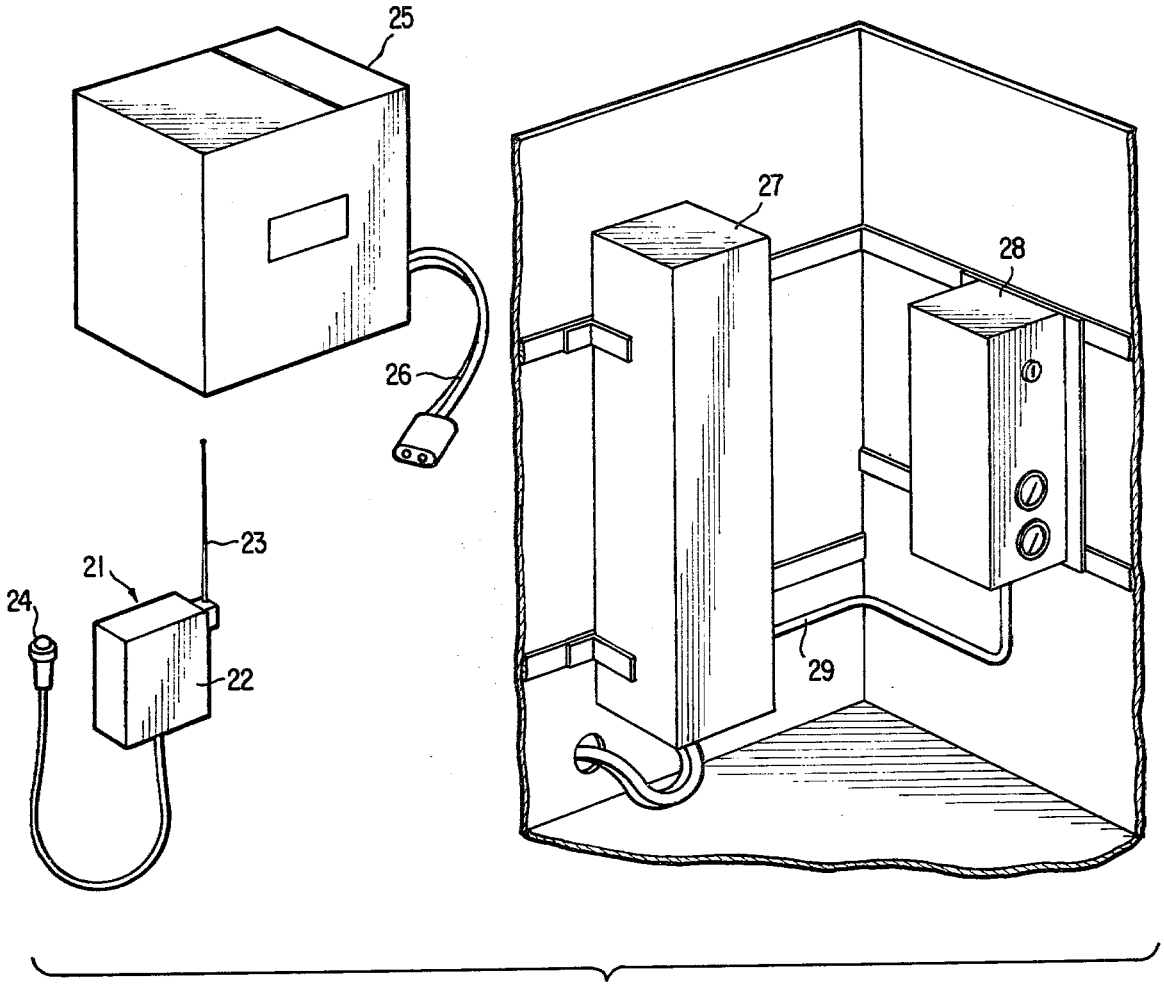
FIG. 2 is a perspective presentation of the principal components of the present invention in an idealized relationship.

In FIG. 2 the principal components of the present invention are shown in somewhat stylized perspective as they might appear installed in a manner different from that shown in FIG. 1 due to the particular configuration of the vehicle upon which are mounted and the possible presence of built-in compartments on the vehicle tools, accessories and the like. In FIG. 2 the transmitting assembly identified as T in FIG. 1 is shown in more detail at 21. The remote transmitter assembly comprises the transmitter unit 22 which for illustrative purposes may be exemplified as a TP-21 transmitter certified by the Federal Communications Commission and having a carrier frequency of 225–310 MHz; a coding tone within a range of 11–19 KHz and requiring power from a $22\frac{1}{2}$ volt battery. The battery is not shown in the drawings as it may be placed anywhere within the work basket and connected by appropriate circuitry to the transmitter 22. A signal from the transmitter some times denoted as an "encoder" is indicated at 23. A switch 24 is employed to activate the transmitter to send out its signal. The signal pulse is received by a receiver in the controller assembly 28 for the powered pressurizer unit which then activates that unit. Such a receiver some times referred to as a "decoder", is exemplified by the RP-203 Receiver certified by the Federal Communications Commission and having a tuning range of 225–310 MHz (adjustable); requiring power of 24 volts DC. When it is determined that the remotely actuated battery powered system is no longer required, another signal pulse is sent from the transmitter assembly 21 which deactivates the battery powered pressurizer unit. The battery powered pressurizer unit does not require a continuous signal from the transmitter assembly 21 to maintain its operation once it has been activated.

In lieu of activation of the system by radio waves, use may be made of a light ray. In this instance, the transmitter would be a battery powered, pencil beam projecting light gun or rod which is normally kept on a receptacle on the work basket or platform. The receiver would be a light sensitive switch which is closed and opened when the beam from the light gun is directed on it. These components are believed to be generally commercially available and illustration thereof is, accordingly, not shown.

The remotely actuated battery powered pressurizer unit requires 36 or 24 volts for operation. This power is normally supplied by either a 36 volt battery or two heavy duty 12 volt batteries arranged in series and normally are placed in a protective casing 25. The battery component is connected to the remainder of the radio controlled battery controlled power unit by connection conduit 26. The battery operated electric motor and pump assembly 27 normally would be placed within a metal casing as shown for convenience not only of attachment to the vehicle but also for protection from the elements. The controller assembly 28 receives the signal from the transmitter assembly 21 and activates the motor pump unit 27 by means of the cable 29. The signal from the transmitter assembly 21 is received by the controller assembly 28 via an antenna connected with the controller assembly. Depending upon the nature of the installation the controller unit antenna may be enclosed within the controller assembly or may be a simple rod-like antenna similar to 23 on the transmitter assembly. The light actuated switch may be on the controller assembly or remote therefrom and connected by an appropriate circuitry to the assembly.

Figure 3:
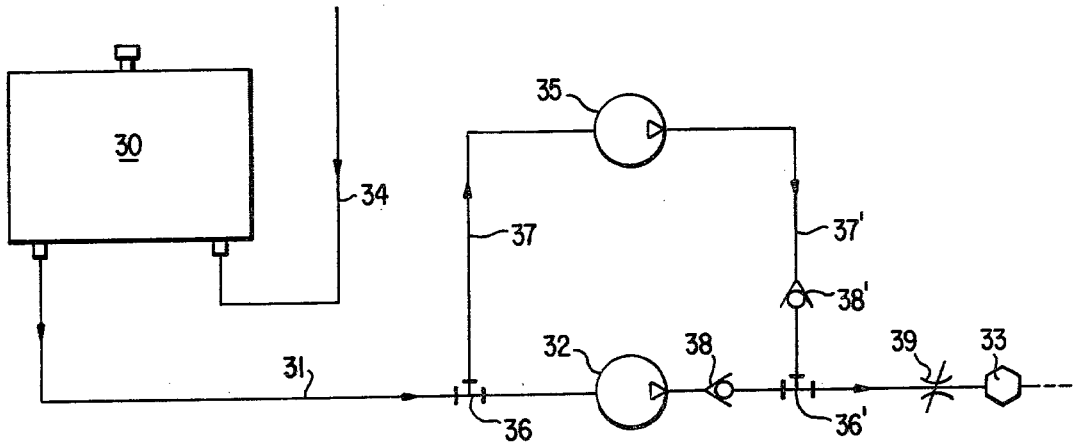
FIG. 3 is a schematic presentation of the hydraulic system of the vehicle shown in FIG. 1 embodying the present invention.

FIG. 3 shows a schematic representation of the hydraulic system of the vehicle shown in FIG. 1 with the interposing of the remotely actuated battery powered pressurizing motor pump and controller unit. In this figure the pressurized tank 30 for the hydraulic system is connected by a line 31 to the pump 32 which is driven by the power take-off from the vehicle engine. From the pump 32 the fluid under pressure is directed to the hydraulic lines 33 in the hydraulic lift arms. The fluid is pressurized by the pump 32 returnss to tank 30 via hydraulic conduit 34. The battery operated motor pump 35 of the present invention is inserted as a bypass around the pump 32 by means of T-couplings 36, 36′ which are installed in lines 31 and 33 on each side of pump 32. The battery powered pressurizing pump 35 is connected by conduit 37 to conduit 31 at coupling 36. When pump 35 is activated, the hydraulic fluid will flow from pump 35 to conduit 33 through conduit 37′ and coupling 36′. To prevent the flow of pressurized fluid in reverse direction to either pump 35 or pump 32 when pump 32 or pump 35 respectively is in operation, there are installed in conduits 33 and 37′ check valves 38 and 38′. Flow control valve 39 is installed in conduit 33 to permit utilization of the required volume of flow depending upon the requirements for operating the hydraulic lift arms of the unit.

Figure 4:
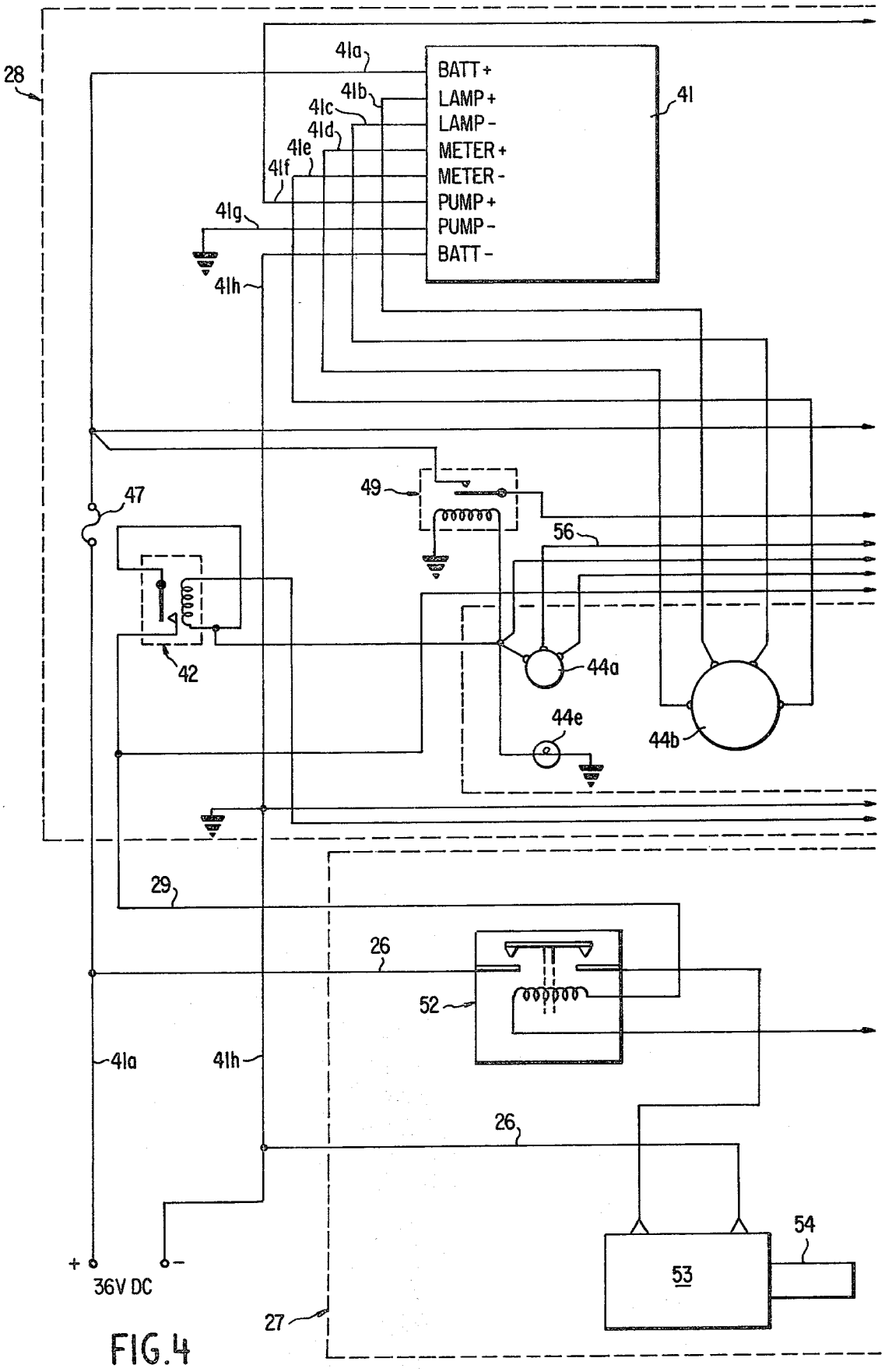
FIGS. 4 and 5 are a schematic presentation of the electrical circuitry of the components of the present invention.
Figure 5:
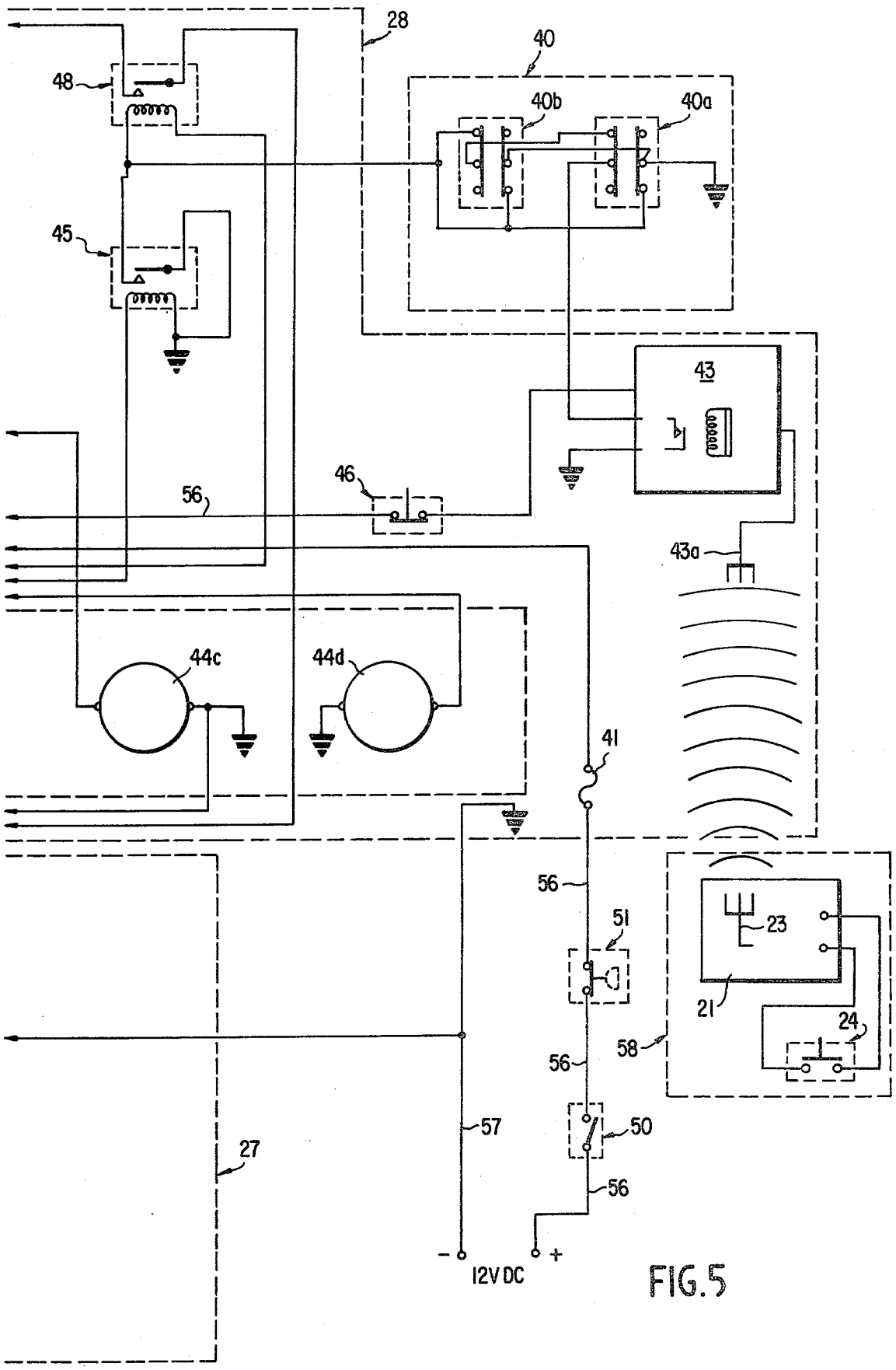

FIGS. 4 and 5 consists of the schematic electric circuitry interconnecting the battery controller component 41, the mainframe switching assembly 40, the receiver or decoder assembly 43, the instrument panel 44, the motor pump assembly 27 and the transmitter or encoder assembly 58.

In FIG. 4 it will be seen that conduit 56 provides 12 volts D.C. through toggle switch 50, located in the cab of the vehicle, which must be closed in order to operate the remotely actuated battery powered controller unit. Conduit 56 proceeds from toggle switch 50 to the vacuum switch 51. Vacuum switch 51 is a vacuum operated switch which is open when the engine of the vehicle is running and this prevents the simultaneous operation of both the main pressure unit as well as the remotely actuated battery powered pressure unit. Conduit 56 proceeds through vacuum switch 51 through fuse 41 to keyed switch 44*a*.

You will note in FIG. 4 that the motor pump assembly 27 is connected to the battery conductor conduit 26, FIG. 2 and extends on to the controller assembly 28 through circuits 41*a* and 41*h*. Circuit 41*h* goes to case ground. Circuit 41*a* extends through fuse 47 to the battery controller 41. Battery controller 41 senses the voltage at circuit 41*a* and if the battery voltage is sufficient to power the motor 53 then a ground from 41*g* will connect, electronically within the battery controller 41, to circuit 41*f* and extend to latching relay 48, thereby rendering the system operative. If the battery voltage is too low, battery controller 41 will sense this and not provide the ground from circuit 41*f* feeding to the contacts on latching relay 48 thus rendering the system inoperative.

Fuel gauge 44*b* is a visual indicator of the batteries remaining charge, as sensed by battery controller 41. Voltmeter 44*c* is an indicator of battery voltage.

When keyed switch 44*a* is turned on, pilot lamp 44*e* will light and 12 Volts D.C. will be applied to relay 42, relay 49 and latching relay 48.

When keyed switch 44*a* is momentarily placed in the start or pulse position, relay 45 is activated and thereby switches latching relay 48. Latching relay 48 controls relay 42. Relay 42 via cable 29 to motor pump assembly 27 controls contactor switch 52. Actuation of the motor pump unit 53, 54 occurs when contactor switch 52 is closed. When relay 42 is actuated, hourmeter 44*d* runs indicating elapsed running time of the motor pump unit.

Latching relay 48 can be activated via three sources. The first source is via the decoder or receiver assembly 43, when it is desired to utilize the transmitter 21 in the work basket. When pushbutton switch 24 at transmitter 21 is depressed, the transmitter 21 sends radio waves via antenna 23 to antenna 43*a* at the receiver 43. A relay in receiver 43 is activated and thereby ratchets latching relay 48. If toggle switches 40*a* or 40*b* are in the up position receiver 43 cannot ratchet latching relay 48 since the conductor between receiver 43 and latching relay 48 will be opened. The light actuating remote unit would similarly operate a relay to ratchet relay 48. The second source is via the keyed switch 44*a* as described above. The third source is via the mainframe switches 40*a* or 40*b*. If toggle switch 40*a* or 40*b* is cycled up and down then latching relay 48 will ratchet position. The second and third sources are normally used only in an emergency such as a worker in the basket being unable to operate the transmitter 21.

Relay 49 is activated when keyed switch 44*a* is placed in the "on" position. Relay 49 via the relay's contacts provides battery power to operate receiver 43. Pushbutton switch 46 is a normally closed switch and when depressed removes the battery power from receiver 43 thereby rendering the receiver inoperative.

It will be understood that various changes in the details, materials and relationship of parts which have been herein described and illustrated in order to explain the nature of this invention may be made by those of skill in the art within the principle and scope of the invention as expressed in the following claims.

It will further be understood that the abstract of the disclosure set forth above is intended to provide a non-legal technical statement of the contents of the disclosure in compliance with the Rules of Practice of the United States Patent and Trademark Office and is not intended to limit the scope of the invention described and claimed herein.

What is claimed is:

1. A remotely actuated, battery-powered, auxiliary pressurization system for the operation of the hydraulic circuit of a device having at least one hydraulically extensible arm independently of the major pressurizing means for said circuit, such means is the major power plant of the device, said arm having a work platform on one end with controls for said circuit, the other end of said arm being movably mounted on said device, said pressurizing system comprising an electrically powered motor/pump assembly connected to said circuit, a controller assembly for said motor/pump assembly and means in said controller assembly to receive activation and de-activation signals from a wireless transmitter mounted on said platform and having a self-contained power source to control the operation of said pressurizing system.

2. The system according to claim 1 wherein said motor/pump assembly comprises an electric motor, a pump connected to said motor and at least one direct current battery to provide at least the required voltage for said motor, said battery being interconnected to said controller assembly and said motor.

3. The system according to claim 1 wherein there are first switching means in said controller assembly to activate said receiving means and a second switching means to control said pressurizing operation of said motor/pump assembly independently of said receiving means.

4. The system according to claim 1 wherein said controller assembly further comprises a battery controller unit, an instrumentation display unit, a switching panel and electric circuits interconnecting said optional battery controller unit, said display unit, said switching panel and said receiving means.

5. The system according to claim 4 further including a safety circuit in said assembly having a switch which is operated by said power plant to prevent simultaneous operation of said auxiliary system and said power plant.

6. On a vehicle having a combustion-type engine as a prime mover and power plant, at least one extensible arm movably mounted at one end on said vehicle and having at least one articulated workbasket connected to the other end of said arm, said arm being adapted for movement in a horizontal and vertical plane, and a hydraulic circuit with controls on said workbasket for moving said arm wherein said hydraulic circuit is pressurized by a pumping assembly operated by said prime mover, a radio actuated pressurizing system having its own power source and connected into said hydraulic circuit to provide the pressurization of the circuit and to operate the movement of said arm by use of said controls when said prime mover is not functioning.

7. The combination according to claim 6 wherein the radio actuated self powered pressurizing system comprises an electrically powered motor/pump assembly, a controller assembly for said motor/pump assembly, means to connect said motor/pump assembly to said hydraulic circuit and means in said controller assembly to receive radio signals from self-powered transmission means on said work basket to control the operation of said assembly.

8. The combination according to claim 7 wherein there are first switching means in said assembly to activate said receiving means and second switching means in said assembly to control operation of said controller assembly independently of said receiving means.

9. The combination according to claim 7 wherein said controller assembly further comprises a battery controller unit, an instrumentation display unit, a main switching panel and electric circuits interconnecting said optional battery controller unit, said display unit, said switching panel and said receiver.

10. The combination according to claim 6 wherein said motor/pump assembly comprises an electric motor, a pump connected to said motor and at least one direct current battery to provide at least the required voltage for said motor, said batteries being interconnected to said controller assembly and said motor.

11. The combination according to claim 9 further including a safety circuit in said controller assembly having a switch which is operated by said prime mover to prevent simultaneous operation of the prime mover and said radio actuated pressurizing system.

12. In an insulated aerial lift having boom structures formed of insulating material for insulating a workman's platform from the remainder of the lift, hydraulic circuitry for movement of the boom structures and platform, and hydraulically operated control valves at the workman's platform for utilizing the position of the boom and platforms in response to pressurization of said hydraulic circuitry, a remotely controlled circuit comprising a self-powered radio transmitter on said workman's platform having a control thereon to provide a control signal for one motion of movement, a receiver on said lift and independently mounted from said boom structures and adapted to respond to the signal received from said transmitter, an electrical circuit connected to said receiver and to a motor/pump assembly to provide a source of hydraulic fluid under pressure for the existing hydraulic circuitry, and a battery connected to said electric circuit to provide a source of power for said receiver, electrical circuit, and motor/pump assembly.

* * * * *